US005078408A

United States Patent [19]

Myers

[11] Patent Number: 5,078,408

[45] Date of Patent: Jan. 7, 1992

[54] BOUNCING CUBE

[76] Inventor: Jeff D. Myers, 7898 E. Acoma Dr., Suite 209, Scottsdale, Ariz. 85260

[21] Appl. No.: 617,545

[22] Filed: Nov. 26, 1990

[51] Int. Cl.[5] ..... A63B 43/00

[52] U.S. Cl. ..... 273/428; 273/58 A; 273/58 K

[58] Field of Search ..... 273/428, 58 A, 58 K

[56] References Cited

U.S. PATENT DOCUMENTS 4,971,334 11/1990 Stewart ..... 273/58 A X

*Primary Examiner*—Paul E. Shapiro

*Attorney, Agent, or Firm*—Warren F. B. Lindsley

[57] ABSTRACT

A cube that bounces and rebounds as a spherical ball comprising a spherical ball of a relatively high density material forming the center of the cube and a body of relatively low density material surrounding the spherical ball to form a cubical configuration whereby the low density material buckles under impact causing the cube's spherical ball to react to the impact and respond as a ball.

5 Claims, 1 Drawing Sheet

BOUNCING CUBE

BACKGROUND OF THE INVENTION

This invention relates to bouncing objects and more particularly to a cube that bounces in the manner of a spherical ball.

DESCRIPTION OF THE PRIOR ART

Since man began playing with toys the spherical ball has been his favorite. Through the ages these spherical balls have been made out of everything from stone, glass, leather and more recently rubber. A common characteristic of all the balls has been its round shape. Those made more recently from rubber may be repeatedly bounced in a predictable manner. However, when the ball has a shape other than that of a sphere it cannot be bounced in a predictable manner.

Thus, a sperical ball can bounce back after impact in a known repeatable manner while a cube will bounce and rebound in an erratic manner.

SUMMARY OF THE INVENTION

In accordance with the invention claimed, a new and improved toy is provided in the form of a cube which bounces and rebounds in the manner of a spherical ball.

It is, therefore, one object of this invention to provide a cube that responds on impact and rebounces as a spherical ball.

Another object of this invention is to provide a cubical object that looks and feels like a cube but bounces as a ball.

A further object of this invention is to provide a new and improved cube containing a dense spherical object located centrally thereof which object is covered by a low density plastic foam like material and which object controls the bounce and rebounce characteristics of the cube when it is used as a ball for bouncing purposes.

A still further object of this invention is to provide a cube the corners, i.e., vertices, of which buckle under impact to insure that a hard spherical ball at the center controls the bounce and rebound action of the cube.

Yet another object, of this invention is to provide a cube having a low density plastic foam like surface surrounding at its center a high density spherical ball.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
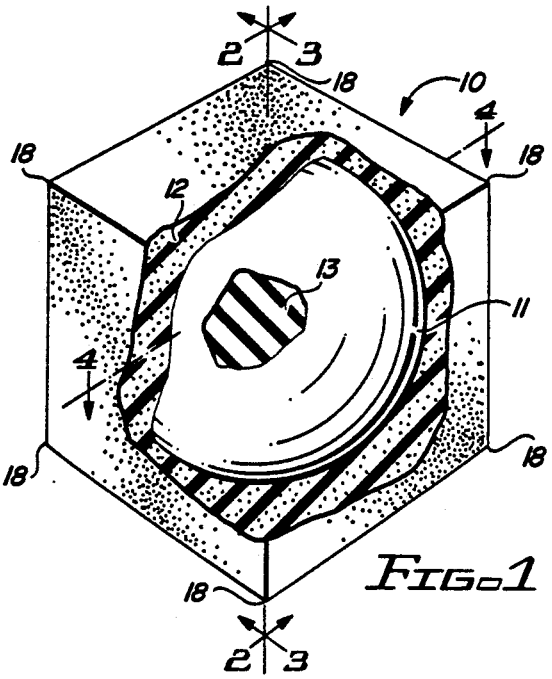
FIG. 1 is a perspective view partially broken away illustrating a cube formed of a low density material surrounding a spherical ball of a denser material and embodying the invention.

Referring more particularly to the drawing by characters of reference, FIGS. 1–4 disclose a cube 10 of a size that may be easily held in the hand of a child or an adult that responds on impact and rebounds like a spherical ball. The size of the cube is to range from one to four inches on a side and should weigh no more than one pound. The cube is intended to feel like a square object.

The cube surrounds a round object positioned centrally thereof which is intended to have a density greater than the foam plastic material 12 forming the remainder of the cube. As shown in the drawing, the round object may be a spherical ball formed of, for example, a live rubber or resilient like material 13 having a density of approximately 0.95 to 1.1 times the density of water.

The remainder of the cube, that is all of it except the spherical center, may be formed of a low density foam like material having a density of approximately 0.04 to 0.15 times the density of water—the standard in the sciences.

Figure 2:
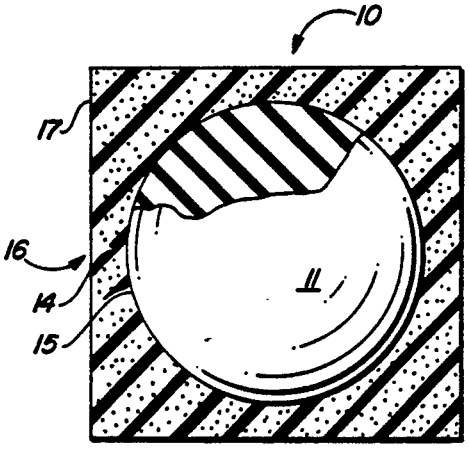
FIG. 2 is a cross sectional view of FIG. 1 taken along the line 2—2.
Figure 3:
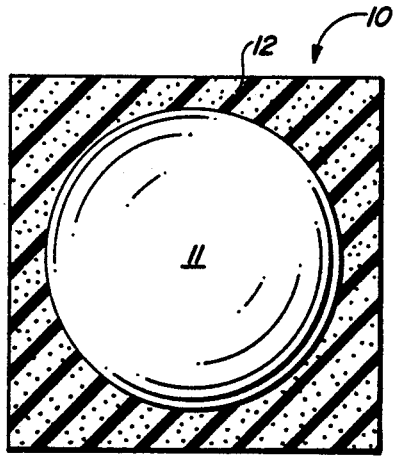
FIG. 3 is a cross sectional view of FIG. 1 taken along the line 3—3.
Figure 4:
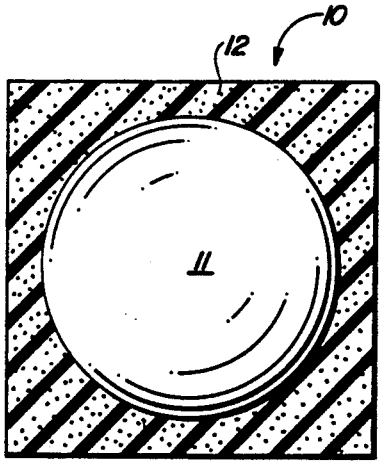
FIG. 4 is a cross sectional view of FIG. 1 taken along the line 4—4.

The thickness of the material, i.e., the distance 14 as shown in FIG. 2, between the surface 15 of the spherical ball 11 and the center 16 of the juxtapositioned outer surface 17 of cube 10 is approximately 1/16 to ½ of an inch.

As designed, the corners 18 of the cube 10 buckle under impact when the cube is bounced or thrown against a wall. Further, the internal sections of the cube also buckle and insure that when hand pressure is applied at the center of the cube's faces, the feel to the handler is similar to the feel of its corners.

The edges of the cube are to be dimensioned as square as it is possible using an injection molding manufacturing process. It has been noted that perfectly square corners of the cube create the instability in the vertices that encourage buckling of the walls of the cube during impact.

The cube is not designed to roll. Under impact conditions the vertices will buckle resulting in the vertex taking the shape that a sphere takes under impact. The cube must impact at a minimum velocity to insure a rebound similar to that of a sphere.

Although but one embodiment of the invention has been shown and described, it will be apparent to those skilled in the art that various changes and modifications may be made therein without departing from the spirit of the invention or from the scope of the appended claims.

What is claimed is:

1. A cube that bounces and rebounds as a spherical ball comprising:

a spherical ball of relatively high density resilient material forming the center of the cube, and a body of relatively low density material surrounding the spherical ball to form a cubical configuration, said relatively high density material comprising a material having a density of approximately 0.95 to 1.1 times the density of water, said relatively low density material comprising a foam material having a density of approximately 0.04 to 0.15 times the density of water, the thickness of said foam material between the center of the surface of each side of the cube and said high density material is approximately 1/16 to ½ of an inch, said cube comprises identical sides between two and a half to four inches in length and weighing less than one pound, whereby the relatively low density material buckles under impact causing the cube's spherical ball to react to said impact and respond as a ball.

2. The cube set forth in claim 1 wherein:

said relatively high density material comprises rubber and, said relatively low density material comprises a foam plastic material.

3. A cube that bounces and rebounds as a spherical ball comprising:

a spherical ball of relatively high density material forming the center of the cube, and a body of relatively low density foam material surrounding the spherical ball to form a cubical configuration, said relatively high density material comprising a resilient material having a density of approximately 0.95 to 1.1 times the density of water, said relatively low density material comprising a foam material having a density of approximately 0.04 to 0.15 times the density of water, the thickness of said foam material between the center of the surface of each side of the cube and said high density material is approximately 1/16 to ½ of an inch, said cube comprises identical sides approximately three inches in length and weighing less than one pound, whereby the relatively low density material buckles under impact causing the cube's spherical ball to react to said impact and respond as a ball.

4. The cube set forth in claim 3 wherein:

the thickness of said foam between the center of the surface of each side of the cube and said high density material is approximately ½ of an inch.

5. The cube set forth in claim 3 wherein:

said low density material comprises a plastic foam.

* * * * *